US005642666A

United States Patent [19]

Petteruti et al.

[11] Patent Number: 5,642,666

[45] Date of Patent: Jul. 1, 1997

[54] HAND-HELD LABEL PRINTER

[75] Inventors: Alfred J. Petteruti; Robert A. Petteruti; Steven F. Petteruti, all of East Greenwich, R.I.

[73] Assignee: Comtec Information Systems, Inc., Warwick, R.I.

[21] Appl. No.: 563,417

[22] Filed: Nov. 28, 1995

[51] Int. Cl.[6] ..... B41F 1/08

[52] U.S. Cl. ..... 101/288; 101/45; 156/384

[58] Field of Search ..... 101/288, 45; 156/384

[56] References Cited

U.S. PATENT DOCUMENTS

| | | | |
|---|---|---|---|
| 3,330,207 | 7/1967 | De Man | 101/288 |
| 3,890,188 | 6/1975 | Sams | 101/291 |
| 4,264,396 | 4/1981 | Stewart | 101/288 |
| 4,267,006 | 5/1981 | Karn et al. | 101/288 |
| 4,274,902 | 6/1981 | Jenkins | 156/344 |
| 4,498,389 | 2/1985 | Hamisch, Jr. | 101/288 |
| 5,061,947 | 10/1991 | Morrison et al. | 346/1.1 |
| 5,227,617 | 7/1993 | Christopher et al. | 235/462 |
| 5,267,800 | 12/1993 | Petteruti et al. | 400/88 |

*Primary Examiner*—Edgar S. Burr
*Assistant Examiner*—Daniel J. Colilla
*Attorney, Agent, or Firm*—M. Lukacher; K. Lukacher

[57] ABSTRACT

A hand-held label printer has an integrated label applicator mechanism pivotably and exchangably disposed in opposing side walls of a printer housing and across a front wall opening in the housing. The label applicator mechanism is pivoted into a label applying position in which the applicator mechanism receives and guides a printed label peeled from a web stock by a peeler rod along a label path extending from the peeler rod over a label shelf of the applicator mechanism to a position from which a label applicator roller of the applicator mechanism can engage a leading portion of the label for application to a surface to be labeled. The label applicator mechanism is pivoted into a web stock threading position to provide ready access by a user of the printer to facilitate threading of a leading portion of web stock along a web stock path from a roll past a printing mechanism and over the peeler rod to a web stock transport mechanism and to facilitate clearing of web stock jams or of label jams. A particular label applicator mechanism is adapted to receive and guide in the label applying position labels having one particular dimension along the label path. For labels having another particular dimension, another applicator mechanism adapted to receive and guide such labels is readily exchanged for the previously deployed label applicator mechanism.

23 Claims, 6 Drawing Sheets

HAND-HELD LABEL PRINTER

FIELD OF THE INVENTION

The present invention generally relates to label printers, and, more particularly, the invention relates to an improved hand-held label printer having a label applicator mechanism which is pivotable between a label applying position and a web stock threading position, and which is selectably exchangeable for another label applicator mechanism when labels of a different dimension along a label path are to be printed. The label applicator mechanism receives and guides labels printed in the printer in the label applying position and applies such labels to a surface to be labeled.

BACKGROUND OF THE INVENTION

Label printers are used to print labels, such as shelf labels, tickets, stickers, and other patches, the information to be printed on a surface of the labels provided by a keypad entry and, alternatively, via a communication link between the label printer and a remote source of information, for example, a central computer linked to the label printer by a connecting cable or by wireless communication. Labels are generally provided in the form of a roll of web stock which is disposed within or on a label printer, where the web stock supports labels which have an adhesive backing releasably attached to one surface of the web stock, with the printing of the information to be carried out on a label surface opposite the releasably attached surface. The web stock and the releasably attached labels are transported within the printer along a defined path from the roll past a printing station which prints the information on the labels, whereupon the releasably attached printed labels are peeled from the web stock in a label peeler station and become available at a label exit port of the printer for application to a surface to be labeled. The web stock is transported along a web stock path to a web stock exit port of the printer.

From the point of view of a user of a label printer on a factory floor, in a warehouse, or in a retail establishment, at least the following aspects of printer performance merit consideration: (i) ease of threading a leading portion of the web stock from the roll of web stock past the printing station and past the label peeler station into engagement with a generally motor-driven web stock transport mechanism; (ii) ease of access to the web stock path past the printing station and the label peeler station so as to facilitate the clearing of jammed web stock and/or the clearing of jammed labels from these portions of a label printer; (iii) ease of access to a label path extending between the label peeler station and the label exit port of the printer so as to facilitate clearing of jammed labels from along the label path; (iv) ease of adaptation of the path length of the label path between the label peeler station and the label exit port to a new supply of labels having a substantially different label dimension along the label path; (v) ease of application of a printed label provided at the label exit port of the printer to a surface to be labeled.

Hand-held printers heretofore proposed do not satisfactorily take into account the aforementioned considerations; see, for example, U.S. Pat. No. 5,267,800, issued on Dec. 7, 1993, U.S. Pat. No. 5,227,617, issued on Jul. 13, 1993, U.S. Pat. No. 5,061,947, issued on Oct. 29, 1991, U.S. Pat. No. 4,264,396, issued on Apr. 28, 1981, and U.S. Pat. No. 4,274,902, issued Jun. 23, 1981.

SUMMARY OF THE INVENTION

The present invention provides a hand-held label printer providing the features of ready access to the printer for threading the web stock past a printing mechanism, for clearing of web stock or label jams, and having a label applicator mechanism which can be pivoted so as to provide that ready access when required, and to be used as a label applicator when pivoted into a label applying position.

Accordingly, it is the principal object of the present invention to provide an improved hand-held label printer having a label applicator mechanism pivotably disposed thereon and which can be pivoted between a web stock threading position and a label applying position such that in the web stock threading position ready access is provided for threading the web stock along a web stock path past a printing station and over a peeler rod to a web stock exit from the printer, and such that in a label applying position of the label applicator mechanism printed and peeled labels are readily transported along a label path to a label applicator for applying labels to a surface to be labeled.

Another object of the invention is to provide an improved hand-held label printer having a label applicator mechanism pivotably disposed thereon with the label applicator mechanism being selectably exchangeable for another label applicator mechanism when labels of a substantially different label dimension along the label path have to be printed and applied to a surface.

A further object of the present invention is to provide an improved hand-held label printer having a label applicator mechanisms pivotably disposed thereon in which the label applicator mechanism is selected to receive and guide a label in a label applying position and to provide a label path dimension along the label path which corresponds to the dimension of a label to be printed.

Briefly described, the present invention, in accordance with a presently preferred embodiment, provides an improved hand-held label printer having a label applicator mechanism which is pivotably and selectably exchangably disposed on the printer. The label applicator mechanism is pivoted to a label applying position in which a printed label, peeled from a web stock of labels by a peeler rod, is guided along a label path extending from the peeler rod over a label shelf to a position from which a label applicator roller can engage a leading portion of the label for application of the label to a surface to be labeled. When ready access is required to a portion of a web stock path extending from a roll of web stock past a printing mechanism and over a peeler rod, the label applicator mechanism is pivoted from the label applying position to a web stock threading position, thereby providing ready access to an opening in a top cover of a housing of the label printer, the housing also having an opening over a portion of a front wall which provides further ready access for threading the web stock from the roll past the printing mechanism and over the peeler rod. This ready access also facilitates the clearing of web stock and label jams from the printer. A roll of web stock supporting releasably attached labels on one surface thereon is receivable in a spool disposed in a tub-shaped recess in one side wall of the printer. The tub-shaped recess extends to the opening in the front wall of the printer, and the recess provides further ready access for threading the web stock along a web stock path which includes a web stock transport means disposed outside the tub-shaped recess and proximate a web stock exit opening in a rear wall of the printer housing.

BRIEF DESCRIPTION OF THE DRAWINGS

The present invention will be better understood and appreciated more fully from the following detailed description, taken in conjunction with the accompanying drawings, in which.

DETAILED DESCRIPTION

Figure 1:
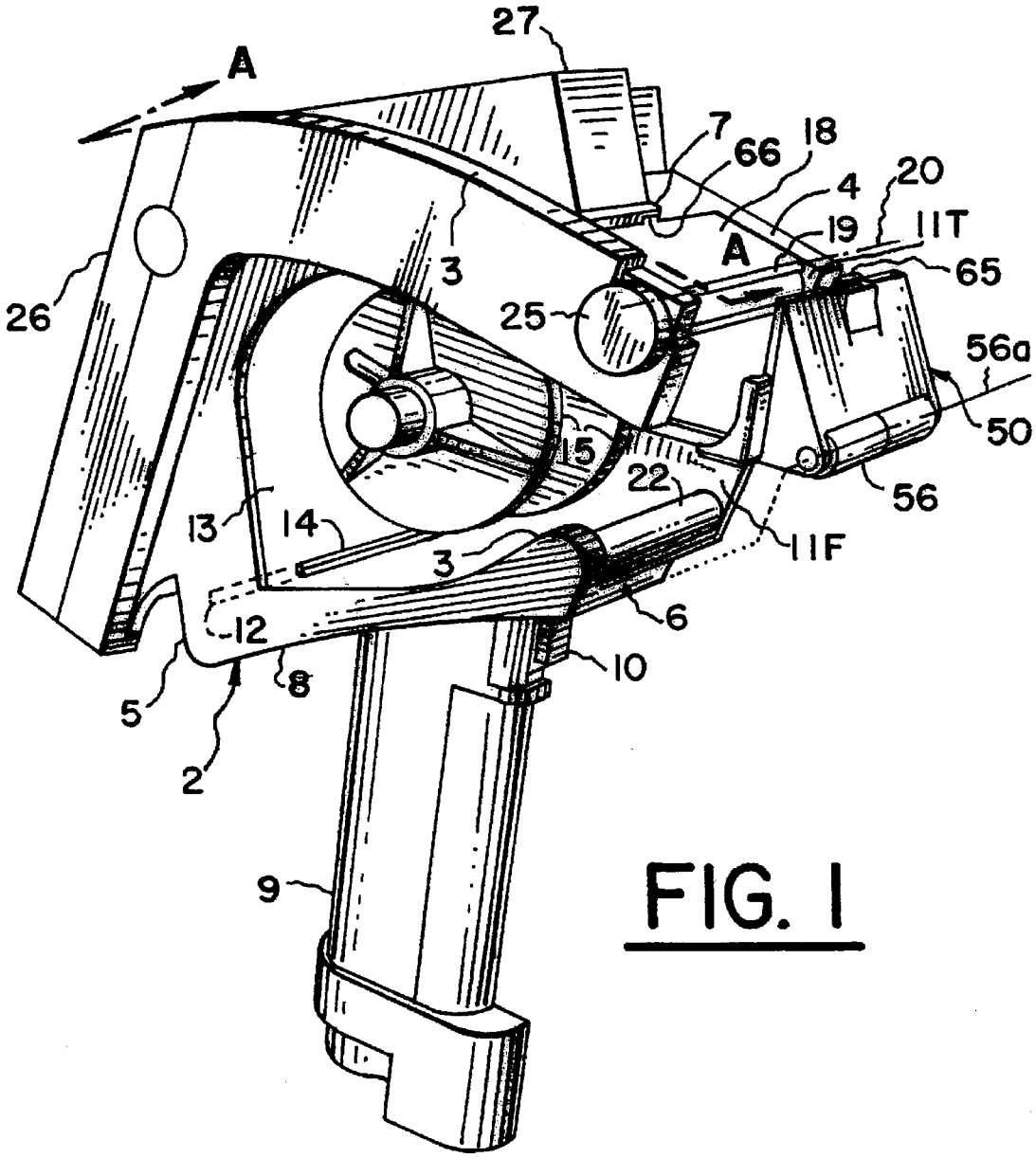
FIG. 1 shows a schematic, perspective view of the hand-held label printer in accordance with the present invention, in which a label applicator mechanism is shown pivotably disposed as being in a web stock threading position, whereby an opening in a top cover is readily accessible for threading web stock and for clearing web stock or label jams.
Figure 2:
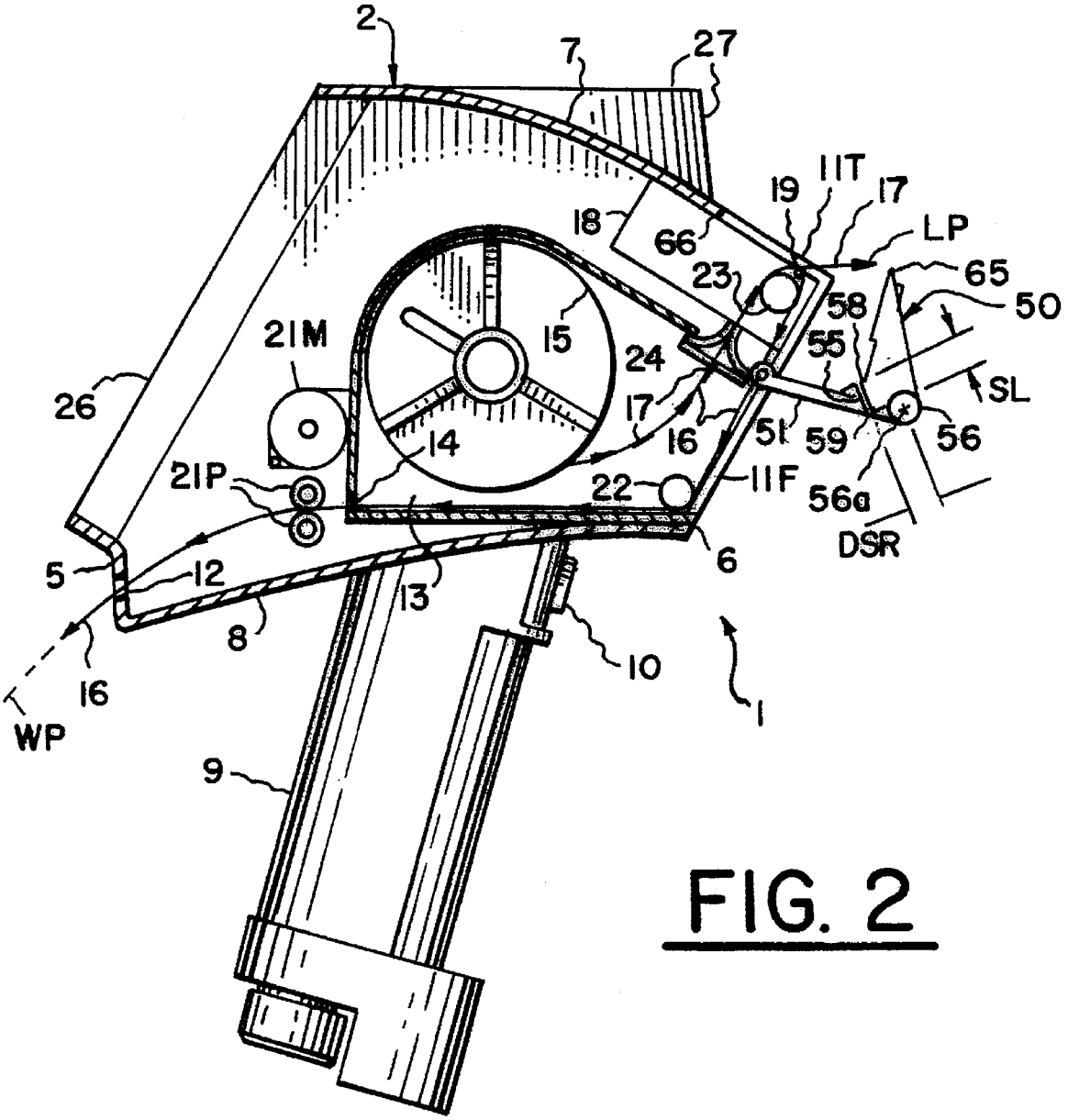
FIG. 2 depicts schematically a cross-sectional side view of the hand-held label printer, sectioned along the lines A—A of FIG. 1, and indicating schematically a web stock path and a label path of the printer, with the label applicator mechanism shown pivoted to a web stock threading position, as well as detailing other features of the printer and the label applicator mechanism not readily apparent in FIG. 1.

Referring now to FIGS. 1 and 2, there is shown a hand-held label printer generally designated at 1 and having a housing 2. The housing 2 has opposite side walls 3 and 4, a rear wall 5 and a front wall 6, a top cover 7 and a bottom cover 8. A handle 9 extends from the bottom cover 8 and contains an actuator 10 projecting from the handle 9. The actuator 10 is used for selectably actuating the printer or scanner. The front wall 6 has an opening 11F, and the top cover 7 has an opening 11T, with the front wall opening 11F and the top cover opening 11T representing a common and continuous opening. The side wall 3 has a tub-shaped recess 13 which extends toward the other side wall 4 in one direction, and which extends into the front wall opening 11F in another direction. The tub-shaped recess 13 has another slit-like opening 14 which is oriented with respect to an opening 12 in the rear wall 5. Disposed within the tub-shaped recess 13 is a spool 15 which receives a roll of web stock 16 supporting labels 17 on one surface, the labels 17 having an adhesive backing releasably attached to the one surface of the web stock. The hand-held label printer 1 also contains a printing mechanism 18 which may be a thermal printer having appropriate control circuits associated therewith, a platen roller 23, and a peeler rod 19 shown disposed above the platen roller 23 and having a central axis 20. The peeler rod 19 functions to release the releasably attached labels 17 from the web stock 16 as the labels and the web stock advance tightly wrapped around a portion of the peeler rod 19, one such label 17 being shown in FIG. 2 as exiting through the top cover opening 11T along a label path LP. The peeler rod 19 is disposed on the printing mechanism 18, for example on side flanges thereof (not shown).

In FIG. 2, there is schematically indicated a web stock path WP extending from the roll of web stock on the spool 15 through a web stock funnel 24, past the printing mechanism 18 and in contact with a portion of the surface of platen roller 23, over the peeler rod 19 where labels 17 are peeled from the web stock 16. The web stock 16 is shown by arrows to proceed along the web stock path WP past an idler roller 22 and along a lower surface of the tub-shaped recess 13 through its slit-like opening 14 into engagement with a web stock transport mechanism to the rear wall opening 12 in the rear wall 5 of the housing 2. The web stock transport mechanism is generally well known, and is therefore indicated only schematically as comprising a pinch roller assembly 21P and a drive motor 21M which is used to drive the pinch roller assembly 21P either through a drive gear or through a drive belt arrangement. The web stock transport mechanism is actuated by the actuator 10 in the handle 9. The motor 21M, for example a stepper motor, will upon actuation drive the pinch roller assembly to transport the web stock along the web stock path WP by a path length equivalent to a length dimension of a label 17 along the web stock and label transport paths. The housing 2 may contain optical detectors (not shown) for detecting label edges or for detecting suitable markings on the web stock, such optical detection of label edges providing a signal through a motor controller (not shown) which will turn off the motor 21M and, therefore, stop the web transport whenever a new label has been advanced into a printing position in the printing mechanism 18 and against a portion of the circumference of the platen roller 23.

The pinch roller assembly 21P, driven by the motor 21M, provides a web stock transport which ensures that the web stock 16 advances along the web stock path WP so that the web stock is tightly wrapped around a portion of the peeler rod 19, thereby effecting the peeling of labels 17 from the web stock 16. The pinch roller assembly 21P may selectably provide a gap between the rollers of the assembly to facilitate the loading or the insertion of the web stock therebetween.

As will be apparent from FIGS. 1 and 2, the web stock funnel 24, the platen roller 23, the printing mechanism 18, the peeler rod 19, the idler roller 22, the slit-like opening 14 in the tub-shaped recess 13, the pinch roller assembly 21P, and the rear wall opening 12 extend substantially across the printer housing 2 between the opposing side walls 3 and 4, as does the front wall opening 11F and the top cover opening 11T.

Figure 4:
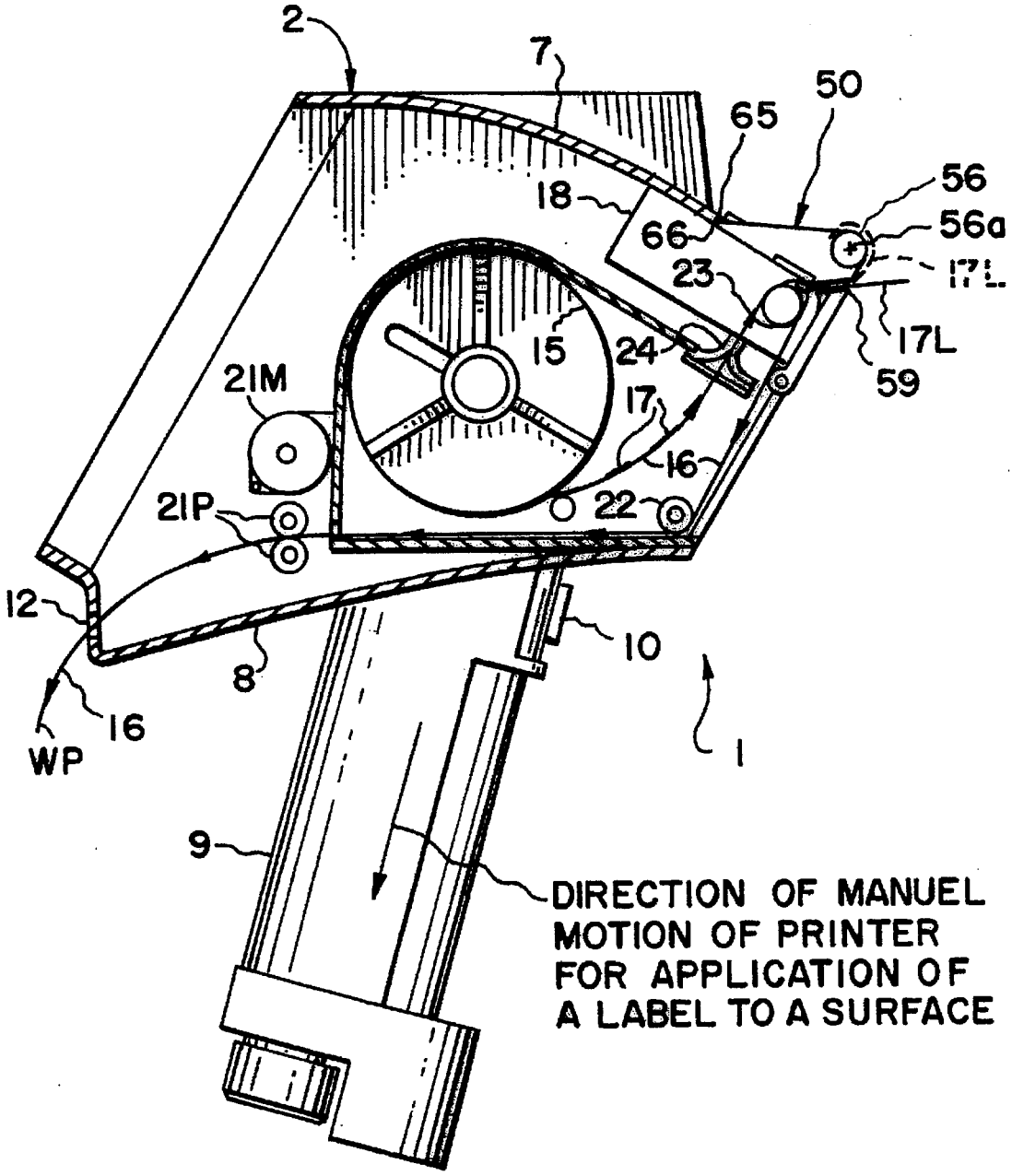
FIG. 4 is a schematic, cross-sectional side view substantially identical with the view provided in FIG. 2, except that the label applicator mechanism is now depicted as being pivoted and latched in a label applying position with a label depicted along a label path extending from a peeler rod through and with a leading portion beyond a label shelf in the label applicator mechanism, and showing the leading portion of the label in dashed outline as being engaged by a label applicator roller for an application of the label to a surface to be labeled by manual motion of the printer handle along a direction indicated thereon.

While the web stock funnel 24 is depicted as a separate element in the schematic, cross-sectional views of FIGS. 2 and 4, the web stock funnel 24 is preferably an integral member of the tub-shaped recess 13, being molded into an upper wall of a molded housing forming the tub or paper well 13.

The tub-shaped recess 13 in the side wall 3 in conjunction with the front wall opening 11F and the top cover opening 11T provide ready and convenient access to a user of the printer 1 for threading the web stock 16 supporting the labels 17 past the printing mechanism 18, over the label peeler rod 19, around the idler roller 22 through the opening 14 in the recess 13, thereby facilitating the threading of the web stock into the pinch roller assembly 21P of the web stock transport mechanism, and from there through the rear wall opening 12. Likewise, the aforementioned openings provide ready access to a user of the printer 1 for clearing web stock jams or label jams from along the web stock or label paths extending within the critical regions from the web stock funnel 24 past the printing mechanism 18 and the platen roller 23 and over the peeler rod 19.

Pivotably disposed between the side walls 3 and 4 of the housing 2 is a label applicator mechanism 50, depicted in FIGS. 1 and 2 as pivoted away from the top cover opening 11T in a direction toward the front wall opening 11F, so as to provide the ready access by a user of the printer described above.

Figure 3A:
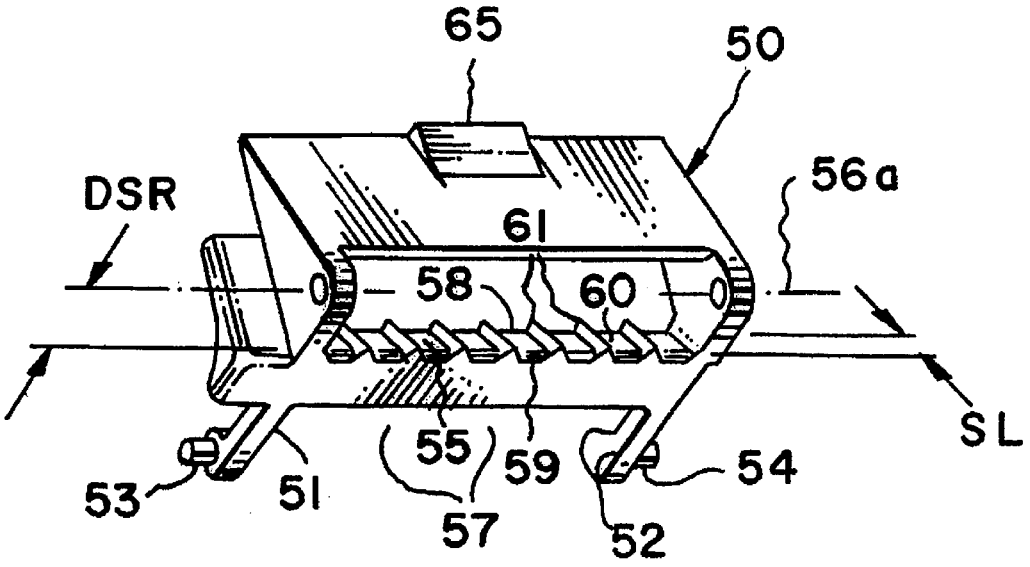
FIG. 3A is a schematic, perspective view of one embodiment of the label applicator mechanism of the hand-held label printer in accordance with the present invention, a label applicator roller having been omitted from FIG. 3A so as to reveal the details of a label shelf.

In the embodiment depicted in FIG. 3A, the label applicator mechanism 50 is an integrated assembly comprising one pivot arm 51 having a cylindrical pivot stub 53 at one end thereof pivotably disposed in a pivot recess (not shown) on an inside of the side wall 3, and another pivot arm 52 having a pivot stub 54 at one end thereof pivotably disposed in a pivot recess (not shown) of the opposing side wall 4 of the housing 2, as indicated in more detail in FIG. 3A. A label shelf 55 is integrally disposed across the other end of each of the pivot arms 51 and 52, and a label applicator roller 56 is disposed on the label applicator assembly 50 in a spaced relationship to the label shelf 55. As shown in greater detail in FIG. 3A, an opening 57 extends in one direction between the pivot arms 51 and 52 and extends in a perpendicular direction between the ends of the pivot arms having the pivot stubs 53 and 54 toward the label shelf 55. The label shelf 55 has a first shelf edge 58 and a second shelf edge 59, the distance between these shelf edges defining a shelf length dimension SL. The label shelf 55 has a shelf surface 60 from which a plurality of ribs 61 are projecting, the ribs 61 extending from the first shelf edge 58 to the second shelf edge 59. The ribs 61 provide a low friction label path with respect to the adhesive backing on the labels, when labels are received and guided by and transported over the shelf along the label path with the label applicator assembly 50 pivoted from the web stock threading position depicted in FIGS. 1 and 2 into a label applying position, also referred to as a label printing position, shown in FIG. 4 and to be described in more detail hereinafter.

The label applicator roller 56 has a central axis **56*a* which is spaced from the peaks of the ribs 61 of the second shelf edge 59 by a distance DSR (see FIGS. 2 and 3) and in a direction upwardly from the shelf edge 59 (see FIG. 4). The label applicator roller 56 shown in FIGS. 1, 2, and 4 has been deleted in FIG. 3A to provide a more detailed view of the label shelf and its surfaces. The label applicator mechanism 50 includes a releasable latching tongue 65 which is engageable in a mating latching recess 66 disposed in the top cover 7 of the housing 2 when the label applicator mechanism 50 is pivoted into the label applying position shown in FIG. 4 from the web stock threading position depicted in FIGS. 1 and 2**.

Figure 3B:
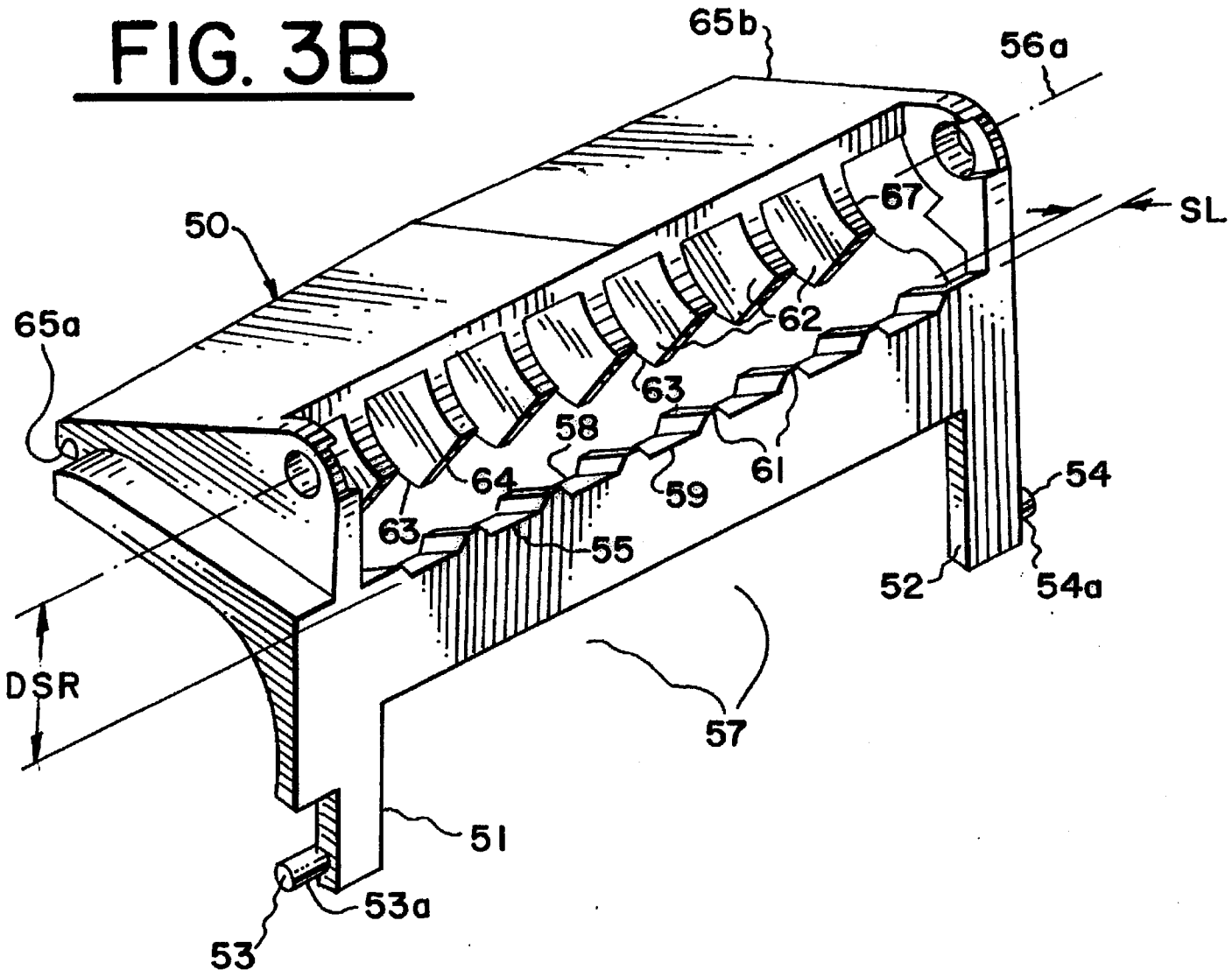
FIG. 3B is a schematic, perspective view of another embodiment of the label applicator mechanism of the hand-held label printer in accordance with the present invention, in which an upper ribbed label guide is disposed in spaced relation to a lower ribbed label shelf, a label applicator roller having been omitted from FIG. 3B for purposes of clarity.

Referring now particularly to FIG. 3B, there is depicted another embodiment of the label applicator mechanism 50, which differs from the label applicator mechanism of FIG. 3A in the following aspect: A plurality of ribs 62 are provided as integral elements of the applicator mechanism 50 and in spaced relation to a lower label shelf 55 and its ribs 61. The ribs 62, together, form an upper label guide which guides labels 17 (peeled from the web stock 16 by the peeler rod 19) downwardly along downwardly curved rib surfaces 63 toward the ribs 61 of the label shelf 55 (see FIG. 3A). The ribs 62 have terminal surfaces 64 and radially convex surfaces 67 and are spaced from the radially convex surface of the label applicator roller 56 (not shown in FIB. 3B for purposes of clarity) having a central axis **56*a*. The upper label guide formed by the plurality of ribs 62 is a particularly advantageous feature of a label applicator mechanism when labels 17 peeled from the web stock 16 by the peeler rod 19 exhibit a relatively high degree of upwardly directed label curl at a leading label edge along the label path. In such instances, the downwardly curved rib surfaces 63 will guide an upwardly curled leading label edge toward and over the label shelf. The degree of label curl observed at the peeler rod 19** depends upon several factors or on a combination of factors, such factors including the composition of the web-stock and the label materials.

Figure 5:
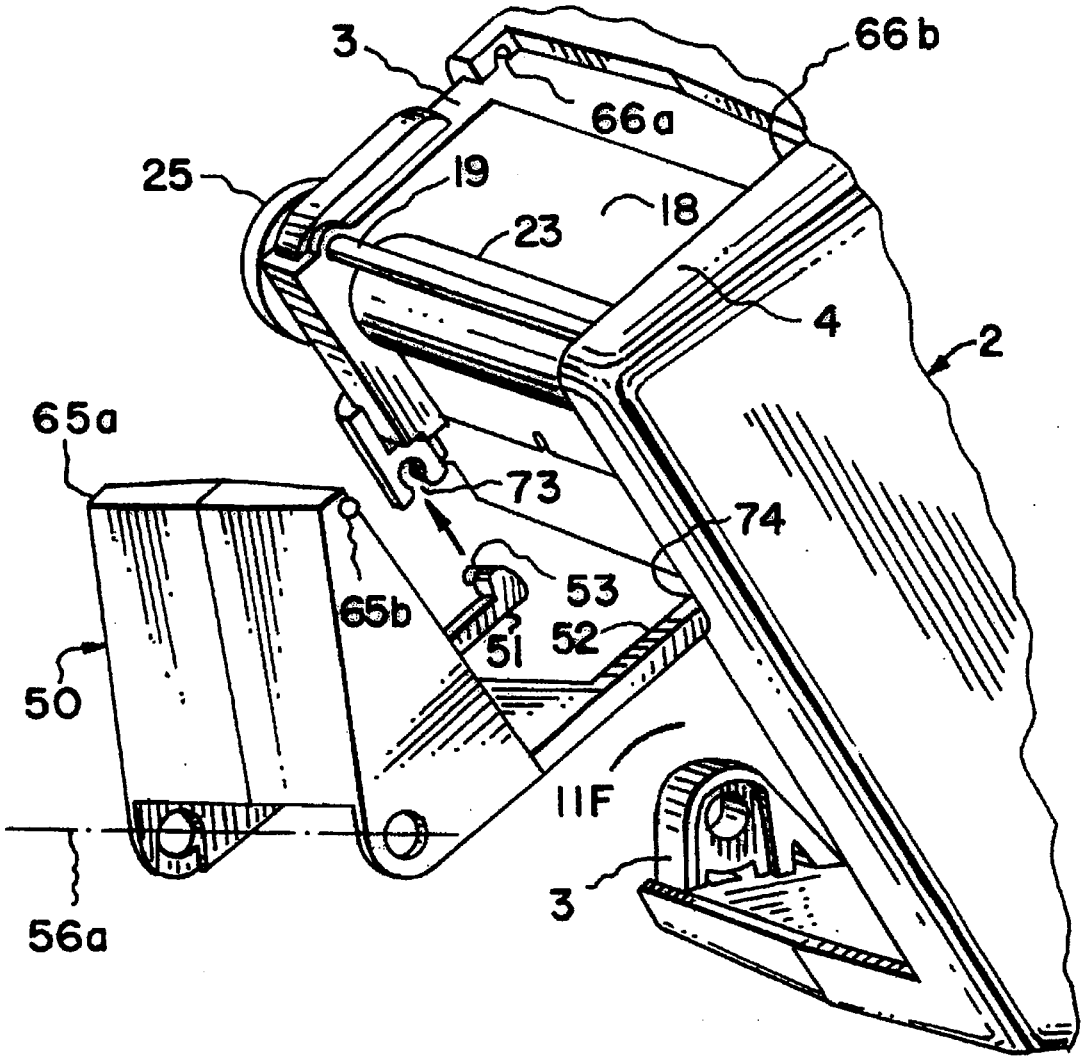
FIG. 5 is a schematic, fragmentary perspective view of a frontal portion of the hand-held label printer in accordance with the present invention, in which one pivot stub on one pivot arm of a label applicator mechanism is indicated by an arrow as being inserted and snapped into a pivoting position in a pivot recess disposed on or in a side wall of a printer housing.

Other aspects of the label applicator mechanism 50 are depicted in the embodiment of FIG. 3B, but are equally applicable in the embodiment shown in FIG. 3A:

(1) Two opposing latch protrusions or latching nipples **65*a* and 65*b* are indicated in FIG. 3B instead of a single latching tongue 65 in FIG. 3A. Two latching recesses 66*a* and 66*b* are indicated on the insides of sidewalls 3 and 4, respectively, of the housing 2 in FIG. 5. When the label applicator mechanism 50 of FIG. 5 is pivoted into a label applying position (not shown), the latching nipples 65*a* and 65*b* of the applicator mechanism 50 of FIG. 3B matingly latch into the corresponding latching recesses 66*a* and 66*b* (FIG. 5**).

(2) In FIG. 3B, the pivot stubs 53 and 54 are indicated as being oval generally and may be cylindrical with opposing flats **53*a* and 54*a*. With reference to FIG. 5, the pivot stubs are inserted into corresponding pivot recesses 73 and 74 in a front portion of sidewalls 3 and 4, and with the label applicator mechanism 50 in a web stock threading position, by inserting one pivot stub (for example pivot stub 54) into its corresponding pivot recess (for example pivot recess 74) and by pushing the other pivot stub (for example pivot stub 53) into a reentrant pivot recess (for example pivot recess 73), as indicated by the arrow extending between the pivot stub 53 and the pivot recess 73, and snapping this pivot stub into a pivoting portion within the pivot recess 73. Removal of the now pivotably disposed label applicator mechanism 50 from the housing 2** occurs by pivoting the applicator mechanism into the web stock threading portion and by pulling one or the other of the shaped pivot pins downwardly for release from its corresponding pivot recess having the reentrant profile. Similarly, a different label applicator mechanism, adapted to receive and to guide labels having a different dimension along the label path, can be inserted and removed.

Referring now particularly to FIG. 4, there is shown the same cross-sectional view of the printer 1 as depicted in FIG. 2, but with the label applicator mechanism 50 pivoted into a label applying position and latched into this position by engagement of the latching tongue 65 in the latching recess 66 of the top cover 7 of the housing 2.

In the label applying position of the label applicator mechanism 50, the ribs 61 at the first shelf edge 58 (see FIGS. 2 and 3) project toward the central axis 20 of the peeler rod 19 (see FIGS. 1 and 2), so that a label 17 peeled by the peeler rod from the web stock 16 during its web stock transport cycle is received and guided by the ribs 61 of the label shelf 55 and transported therein along a label path. The label shelf 55 and ribs 61 of shelf surface 60 is extending in an upward direction toward the roller 56 from the first shelf edge 58 to the second shelf edge 59. For labels 17 having a particular dimension along the web stock and label paths, the label applicator mechanism 50 is selected to provide a shelf length dimension SL and a distance DSR between the peaks of the ribs 61 of the shelf surface 60 and the central axis 56*a* of the label applicator roller 56 (see FIG. 2). Thus, the label applicator mechanism 50 is selected to match the length dimension of a label 17 along the label path LP (see FIG. 2) such that the label shelf 55 guides a label 17 toward the applicator roller 56 with at least a leading portion 17L projecting beyond the second edge 59 of the label shelf 55 to a position from which the applicator roller 56 can engage the label for application to a surface to be labeled by manual motion of the label printer 1 along this surface, as schematically indicated in FIG. 4 by the dotted outline of the leading portion 17L of the label. To apply a label 17 to a surface to be labeled, the label printer 1 is moved manually along this surface such that the applicator roller 56 is in frictional pressure contact with the label 17 against the surface to be labeled, the direction of motion of the printer for label application to a surface being indicated by an arrow along the handle 9 in FIG. 4.

Thus, on one hand the path length of the label path is given by a length dimension of a label 17 along the label path, where the label path extends from the peeler rod 19 over the label shelf 55 to a leading edge of the label within the leading label portion 17L. On the other hand, the shelf length dimension SL and the distance DSR between the second shelf edge 59 of the shelf surface and the central axis 56*a* of the applicator roller 56 are selected in a particular label applicator mechanism 50 to be adapted to a particular dimension of a label 17 along the label path.

When it is required to insert a new roll of web stock supporting new labels having a different length dimension along the label path LP, a new label applicator mechanism 50, is exchanged for the previously used label applicator mechanism. The new label applicator mechanism has a shelf length SL and a shelf-to-roller distance DSR adapted to the different length dimension of the new labels. The exchange of a label applicator mechanism 50 of the embodiment shown in FIG. 3A is accomplished by gently squeezing the pivot arms 51 and 52 toward each other, thereby releasing the pivot stubs 53 and 54 from their respective pivot recesses (not shown) in the side walls 3 and 4 of the housing 2. A selected new label applicator mechanism is then inserted by gently squeezing its pivot arms 53 and 54 toward each other so that the respective pivot stubs 53 and 54 can be inserted into the corresponding pivot recesses in the side walls 3 and 4.

Other features of the hand-held label printer 1 (not shown in the drawings) may include a keypad data entry module and various printer status indicators preferably disposed within a rear cover plate 26, an optical scanner for reading optically discernible information such as, for example, bar code symbols and alphanumeric symbols, disposed within the prism-shaped projections 27 of the housing 2, control circuitry for the optical scanner, data processing and data readout means associated with an optical scanner, and a wired or a wireless communication link between the hand-held label printer and a remote data terminal such as, for example, a centrally located computer terminal.

The printer housing 2 is preferably constructed of two separate and separable mating housing shells, as schematically depicted in FIG. 1, in which one housing shell is shown in solid outline of the side wall 3 and a portion of the front wall 6 as well as a portion of the top cover 7. A second housing shell (not otherwise identified in FIG. 1) is indicated in dotted outline form which is particularly evident as an extension of the solidly outlined portion of the front wall 6 proximate the idler roller 22 in FIG. 1. One of the housing shells, for example, the housing shell shown in solid outline in FIG. 1, has disposed therein the tub-shaped recess 13 in the side wall 3, one pivot recess for accepting a pivot stub of the label applicator mechanism 50 in the side wall 3, substantially the full front wall opening 11F and substantially the full top cover opening 11T, the printing mechanism 18, the peeler rod 19, the web stock transport mechanism 21P and 21M, approximately one half of the top cover 7, one half of the bottom cover 8, one half of the handle 9 extending from the bottom cover 8, and approximately one half of the rear wall 5 including one half of the rear wall opening 12. The other housing shell has disposed in its side wall the other one of the pivot recesses, the other half of the top cover 7, the other half of the bottom cover 8 including the other half of the handle 9, and the other half of the rear wall 5 including the other half of the rear wall opening 12. The two housing shells are readily assembled to form the housing 2, and are held together by fastening elements such as, for example, by screws. The housing 2 is readily separable into its two shells by releasing the fastening elements in order to perform repairs or printer upgrade functions. Preferably, the housing shells are molded plastic shells having integrally molded support surfaces for supporting the various members of the printer.

Indicated in FIG. 1, is a knob 25 which provides selectably for manual rotation of the platen roller 23. The knob 25 is shown disposed on the outside of side wall 3, and the knob can be selectably engaged with the platen roller 23 to facilitate manual threading of a leading edge of the web stock 16 along the web stock path WP until a leading edge of the web stock is in engagement with the pinch roller assembly 21P of the web stock transport mechanism.

The handle 9 may contain a source of electrical power for operation of the printer, for example, in the form of batteries.

From the foregoing description of a preferred embodiment, it will be apparent that a hand-held label printer has been provided which facilitates ready access by a user of the printer through a tub-shaped side wall recess and through an opening in the front wall and in a portion of the top cover for the purposes of threading web stock along a web stock path within the printer, and for clearing web stock or label jams from critical regions within the printer. The printer has a pivotably disposed label applicator mechanism which is pivotable between a web stock threading position and a label applying position. In the web stock threading position, the label applicator mechanism is pivoted away from the top cover opening toward the front wall opening of the printer housing, thereby providing the ready access to the printer for web stock threading and for clearing of web stock or label jams. In the label applying position, the label applicator mechanism receives and guides a label peeled from the web stock by a peeler bar along a label path over and through a label shelf so that a leading portion of a label can project beyond the label shelf for engagement of the label by a label applicator roller for application of the label to a surface to be labeled. The label applicator mechanism is an integrated unit, and is selectably exchangeable for another label applicator mechanism whose label path is adapted to receive and guide a label having another length dimension along a label path. Various modifications of the hand-held label printer and its pivotably and exchangably attached label applicator mechanism may suggest themselves to those skilled in this art. Such modifications are considered to be within the spirit and scope of the invention, as it is defined in the claims.

What is claimed is:

1. A hand-held label printer comprising a housing, said housing having opposite side walls, a rear wall and a front wall, a top cover and a bottom cover, said front wall and a portion of said top cover having an opening, one of said side walls having a tub-shaped recess, said recess extending toward the other of said side walls and extending into said opening in said front wall, said tub-shaped recess having another opening oriented with respect to said top cover opening, a spool within said recess for receiving a roll of web stock, said web stock supporting labels having an adhesive backing releasably attached to one surface of said web stock, a printing mechanism for printing information on a surface of said labels opposite said releasably attached surface, a peeler rod disposed on said printing mechanism and extending across said top cover opening, said peeler rod having a center axis, means in said housing defining a path of transport for said web stock extending from said roll of web stock past said printing mechanism and over said peeler rod through said tub-shaped recess to said rear wall opening, transport means in said housing for transporting said web stock along said web stock transport path by a distance equal to a dimension of a label along said web stock path, and a label applicator mechanism, said label applicator mechanism pivotably and selectably exchangably disposed in said side walls proximate said front wall opening and extending thereacross, said applicator mechanism receiving a label peeled from said web stock by said peeler rod during said transport of said web stock, said applicator mechanism having means defining a label path therethrough, and having means for applying said label to a surface to be labeled.

2. The label printer of claim 1, wherein said label applicator mechanism is an integrated assembly which is selectably pivoted away from said top cover opening toward said front wall opening into a web stock threading position to facilitate threading of said web stock along said web stock path, and which is selectably pivoted toward said top cover opening into a label applying position to dispose said label path defining means and said label applying means for applying said label to said surface to be labeled.

3. The label printer of claim 2, wherein said integrated assembly of said label applicator mechanism comprises two pivot arms, one end of each of said pivot arms having a pivot stub pivotably engaged in a pivot recess on each of said side walls of said housing, a label shelf integrally disposed across the other end of each of said pivot arms, said label shelf receiving a label peeled from said web stock by said peeler rod when said label applicator mechanism is pivoted into said label applying position, a label applicator roller disposed on said assembly in spaced relation to said label shelf, said label applicator roller having a center axis, said label shelf guiding said label toward said applicator roller so that at least a leading portion of said label is projected beyond said label shelf to a position from which said applicator roller can engage said label for application thereof to said surface to be labeled by manual motion of said label printer along said surface with said applicator roller in frictional pressure contact with said label against said surface, and an opening extending in one direction between said one end of each of said pivot arms and said label shelf and extending in another direction perpendicular to said one direction between said two pivot arms.

4. The label printer of claim 3, wherein said label path extends in said label applying position from said peeler rod over said label shelf to said leading portion of said label projecting from said shelf toward said applicator roller, said label path defining means being said label shelf, and said label applying means being said label applicator roller.

5. The label printer of claim 4, wherein said label path has a path length equal to a dimension of a label peeled from said web stock during said transport thereof past said peeler rod.

6. The label printer of claim 5, wherein said path length of said label path is adapted to said dimension of said label by exchanging one selected label applicator mechanism for another one when one roll of said web stock supporting labels having one dimension along said web stock transport path is exchanged for another roll of said web stock supporting labels having another dimension along said web stock transport path.

7. The label printer of claim 6, wherein said path length of said label path in said label applying position of said label applicator mechanism is defined by a shelf length dimension along said label path, said shelf length dimension extending between a first shelf edge disposed proximate said peeler rod and a second shelf edge, and a dimension along said label path corresponding to said at least leading portion of said label projected beyond said second shelf edge to said position from which said applicator roller can engage said label for application thereof to said surface to be labeled.

8. The label printer of claim 7 further comprising an upper label guide, said label guide disposed above and in spaced relation to said label shelf, said label guide having a plurality of ribs, each of said ribs providing a rib surface which is curved downwardly in a direction toward said label shelf, said downwardly curved rib surfaces of said upper label guide directing and guiding a label peeled from said web stock toward and onto said label shelf when said label applicator mechanism is pivoted into said label applying position.

9. The label printer of claim 7, wherein said label shelf has a label path surface, said surface having a plurality of ribs projecting therefrom, said ribs extending from said first shelf edge to said second shelf edge along said label path, and said ribs providing a low friction label path with respect to said adhesive backing on said labels.

10. The label printer of claim 9, wherein said ribs at said first shelf edge project toward said center axis of said peeler rod as viewed in a direction along said label path, and said ribs at said second shelf edge are spaced from said center axis of said label applicator roller as viewed in a direction vertical to said label path.

11. The label printer of claim 10, wherein said label path surface and said ribs of said label shelf extend upwardly from said first shelf edge to said second shelf edge along said label path.

12. The label printer of claim 2, further comprising at least one releasable latch disposed on said label applicator mechanism, said latch engageable in at least one mating latching recess disposed in said housing, said label applicator mechanism being latched to said housing when said label applicator mechanism is in said label applying position.

13. The label printer of claim 1, wherein said web stock transport means comprises a pinch roller assembly, and a motor, said motor driving said pinch roller assembly, said pinch roller assembly and said motor disposed on said one side wall of said housing having said recess, said pinch roller assembly disposed in a location proximate said rear wall opening and outside of said tub-shaped recess, said web stock threaded through said pinch roller assembly, and said web stock transported along said web stock transport path through said rear wall opening.

14. The label printer of claim 13, wherein said web stock transport means further comprises at least one idler roller disposed on said one side wall of said housing having said recess within said bottom cover proximate said front wall opening, and a platen roller disposed in said side wall of said housing having said recess in said portion of said front cover opening proximate said printing mechanism and disposed below said peeler rod as viewed in a direction vertical to said label path.

15. The label printer of claim 3, wherein said web stock transport path further includes said opening defined by said two pivot arms in said one direction and by said one end of each of said pivot arms and said label shelf in said other direction, and a web stock funnel, said funnel extending from said tub-shaped recess toward said printing mechanism, said funnel guiding said web stock from said roll of web stock for passage between said printing mechanism and said platen roller and thence over said peeler rod.

16. The label printer of claim 1, wherein said spool receiving said roll of web stock is disposed in said tub-shaped recess of said one side wall, said path of transport of said web stock being readily accessible for threading thereof and for clearing web stock jams therealong.

17. The label printer of claim 3, wherein said housing also has a handle extending from said bottom cover, said handle having an actuator projecting therefrom for selectably actuating said printer, said handle is an integral part of said housing, said transport means actuated by said actuator, said housing comprising two separable housing shells, one of said shells having disposed therein said tub-shaped recess in said one side wall, one of said pivot recesses being in said one side wall, said opening in said front wall and in said portion of said top cover, said printing mechanism, said peeler rod, said web stock transport means, one half of said top cover, one half of said bottom cover including one half of said handle extending therefrom, and one half of said rear wall including one half of said rear wall opening, the other of said shells having disposed therein said other pivot recess in a side wall thereof, the other half of said top cover, the other half of said bottom cover including the other half of said handle, and the other half of said rear wall including the other half of said rear wall opening.

18. The label printer of claim 14, wherein said platen roller is selectably manually rotatable, said selectable manual rotation provided by a knob, said knob disposed on said side wall having said recess, and said knob being selectably engageable with said platen roller for manual rotation thereof, whereby said web stock is threaded manually along said web stock path until a leading edge of said web stock is in an engagement with said web stock transport means.

19. A label applicator system for a hand-held label printer having a housing with a front wall with an opening, sidewalls, and a top wall with an opening, and which applies, to a surface, labels peelably disposed on web stock which is transported to said top cover opening, a plurality of separate label applicator mechanisms for handling labels of different sizes each comprising means pivotly and selectively exchangeably disposing different ones of said plurality of mechanisms in its entirety in said sidewalls proximate to said front wall and extending thereacross, said applicator mechanisms each having means for receiving a label of one of said different sizes peeled from said web stock during said transport of said web stock to said top cover opening, said applicator mechanisms each having means defining a label path therethrough and having means for applying said labels to said surface for labeling said surface.

20. The label applicator system of claim 19 wherein each of said mechanisms is provided as an integrated assembly of said disposing means, said path defining means and said applying means, and further comprising means for mounting selected ones of said integrated assemblies on said housing for selectively pivoting into and out of said covering opening from a label-applying position into a web stock threading position to facilitate threading of said web stock in said housing.

21. The label applicator system of claim 20, wherein said integrated assembly each of said label applicator mechanisms comprises two pivot arms, one end of each of said pivot arms having a pivot stub pivotably engaged in a pivot recess on each of said side walls of said housing, a label shelf integrally disposed across the other end of each of said pivot arms, said label shelf receiving a label peeled from said web stock when said label applicator mechanism is pivoted into said label applying position, a label applicator roller disposed on said assembly in spaced relation to said label shelf, said label applicator roller having a center axis, said label shelf guiding said label toward said applicator roller so that at least a leading portion of said label is projected beyond said label shelf to a position from which said applicator roller can engage said label for application thereof to said surface to be labeled by manual motion of said label printer along said surface with said applicator roller in frictional pressure contact with said label against said surface, and an opening extending in one direction between said one end of each of said pivot arms and said label shelf and extending in another direction perpendicular to said one direction between said two pivot arms.

22. The label applicator system of claim 21, wherein said mechanisms further comprise an upper label guide, said label guide disposed above and in spaced relation to said label shelf, said label guide having a plurality of ribs, each of said ribs providing a rib surface which is curved downwardly in a direction toward said label shelf, said downwardly curved rib surfaces of said upper label guide directing and guiding a label peeled from said web stock toward and onto said label shelf when said label applicator mechanism is pivoted into said label applying position.

23. The label applicator system of claim 19 wherein said mechanisms each have shelves of different length defining in part said label path.

* * * * *